US011781202B1

(12) United States Patent
Chen et al.

(10) Patent No.: US 11,781,202 B1
(45) Date of Patent: Oct. 10, 2023

(54) ALUMINUM ALLOY FOR NEW ENERGY VEHICLE INTEGRAL DIE-CAST PART, PREPARATION METHOD THEREFOR AND APPLICATION THEREOF

(71) Applicant: Suzhou Huijin Smart Materials Technology Co., Ltd., Changshu (CN)

(72) Inventors: Xi Chen, Changshu (CN); Hongbin Xing, Changshu (CN); Kehong Jiang, Changshu (CN); Jian Wang, Changshu (CN); Yinpeng Zhou, Changshu (CN); Shiyi Wang, Changshu (CN); Wenbo Liu, Changshu (CN)

(73) Assignee: Suzhou Huijin Smart Materials Technology Co., Ltd., Changshu (CN)

( * ) Notice: Subject to any disclaimer, the term of this patent is extended or adjusted under 35 U.S.C. 154(b) by 0 days.

(21) Appl. No.: 18/097,964

(22) Filed: Jan. 17, 2023

(30) Foreign Application Priority Data

Sep. 14, 2022 (CN) ..... 202211112532.5

(51) Int. Cl.

| | |
|---|---|
| ***C22C 1/02*** | (2006.01) |
| ***B22D 17/20*** | (2006.01) |
| ***B22D 21/00*** | (2006.01) |
| ***C22C 21/02*** | (2006.01) |

(52) U.S. Cl.
CPC ..... *C22C 21/02* (2013.01); *B22D 17/20* (2013.01); *B22D 21/007* (2013.01); *C22C 1/026* (2013.01)

(58) Field of Classification Search
CPC ..... C22C 21/02; C22C 1/026; C22F 1/043; B22D 21/007; B22D 17/20
See application file for complete search history.

(56) References Cited

U.S. PATENT DOCUMENTS

| | | | |
|---|---|---|---|
| 6,824,737 | B2 | 11/2004 | Koch |
| 7,108,042 | B2 | 9/2006 | Koch |
| 2016/0271688 | A1 | 9/2016 | Wuest et al. |
| 2019/0119791 | A1 * | 4/2019 | Wiesner ..... C22F 1/043 |

FOREIGN PATENT DOCUMENTS

| | | | |
|---|---|---|---|
| CN | 105986152 | A | 10/2016 |
| CN | 106011847 | A | 10/2016 |
| CN | 108359855 | A | 8/2018 |
| CN | 110588099 | A | 12/2019 |
| CN | 111607760 | A | 9/2020 |
| CN | 114293058 | A | 4/2022 |
| CN | 114438377 | A | 5/2022 |
| CN | 114921696 | A | 8/2022 |
| EP | 1443122 | A1 | 8/2004 |
| EP | 1612286 | A2 | 1/2006 |

* cited by examiner

*Primary Examiner* — Jessee R Roe
(74) *Attorney, Agent, or Firm* — Blank Rome LLP

(57) ABSTRACT

Disclosed is an aluminum alloy for a new energy vehicle integral die-cast part, a preparation method therefor and an application thereof. The alloy includes 7-9 wt % of Si, 0.05-0.25 wt % of Mg, Cu<0.5 wt %, Zn<0.5 wt %, 0.001-0.20 wt % of B, 0.05-0.2 wt % of Ti, 0.1-0.9 wt % of Mn, 0.05-0.3 wt % of Fe, 0.005-0.5 wt % of Sr, Ce<0.5 wt %, 0.01-0.1 wt % of Zr, 0.001-0.3 wt % of Mo, a sum of weight percentages of remaining impurities being controlled to be 1.0 wt % or less, and the balance being Al. Compared with the prior art, the alloy significantly improves an elongation of a material and effectively improves a strength of the material, such that the material has a tensile strength of 260-300 MPa, a yield strength of 110-130 MPa and an elongation of 10-14%.

9 Claims, No Drawings

ALUMINUM ALLOY FOR NEW ENERGY VEHICLE INTEGRAL DIE-CAST PART, PREPARATION METHOD THEREFOR AND APPLICATION THEREOF

RELATED APPLICATION

This application claims priority to Chinese Patent Application No. 202211112532.5, filed on Sep. 14, 2022, which is now Chinese Patent No. CN115181878B. The content of this application is incorporated herein by reference in its entirety.

TECHNICAL FIELD

The present invention relates to a new energy vehicle, and particularly to an aluminum alloy for a new energy vehicle integral die-cast part, a preparation method therefor and an application thereof.

BACKGROUND ART

A new energy vehicle lower body comprises a forward engine room, a battery compartment and an integral die-cast rear floor. The integral die-cast part generally has the characteristics of a large size, a thin wall thickness, a complex structure, etc., which puts forward higher requirements for the performance of aluminum alloy materials.

For traditional die-cast aluminum alloys for automobile, a heat treatment is a necessary process in order to ensure the mechanical properties of automobile components and parts; however, the heat treatment may cause the components and parts to have surface defects and dimensional deformation, leading to a reduced product yield and huge potential cost risks. Therefore, aluminum alloys suitable for integral die casting for new energy vehicles cannot be heat-treated. Under heat-free treatment conditions, the materials are required to have a high toughness as collision, fatigue, SPR connection, etc. should all be taken into consideration. At present, the farthest filling distance of an integral die-cast structural part reaches 2 m or more, which requires the material to have excellent casting performance to ensure excellent mold filling capacity. The use of recycled materials and sprue materials for automobile components and parts in the future requires the materials to have a relatively high tolerance to impurity elements, especially the element Fe. In summary, high-strength-and-toughness die casting aluminum alloys suitable for new energy vehicle integral die-cast parts necessarily have the characteristics of a high strength and toughness under heat-treatment-free condition, an excellent casting performance, and a relatively high tolerance to impurity elements. The traditional die casting aluminum alloys used for automobile components and parts can no longer meet the requirements thereof.

Patent application CN 114293058 A discloses a method for preparing a heat-treatment-free high-strength-and-toughness material suitable for cast parts with various wall thicknesses. The alloy comprises 5-8 wt % of Si, 0.30-0.50 wt % of Mg, 0.05-0.20 wt % of Ti, 0.01-0.03 wt % of Sr, Cu≤0.20 wt %, Fe≤0.20 wt %, Zn≤0.10 wt %, 0.5-0.8 wt % of Mn, 0.05-0.20 wt % of Nb, 0.01-0.03 wt % of B, 0.05-0.20 wt % of Cr, 0.06-0.15 wt % of La, and 0.04-0.10 wt % of Ce, with the sum of impurities being ≤0.2 wt %, wherein if the range of the content of the element Si is relatively low, it will have poor fluidity, be less suitable for a new energy vehicle integral large die-cast part, and easily cause less extension at the distal end for the portion of a large die-cast part most distal to a sprue; and the content of Fe in the patent is relatively low, which may affect, to a certain extent, the use of recycled materials and sprue materials for automobile components and parts to achieve a low-carbon goal.

Patent application CN 114438377 discloses a high-strength-and-toughness die casting aluminum alloy for a new energy vehicle and a preparation method therefor. The alloy comprises, in percentage by weight, the following elements: 8-10 wt % of Si, 0.05-0.5 wt % of Fe, Mn<1.0 wt %, 0.1-0.5 wt % of Mg, 0.1-1.0 wt % of Cu, Zn<1.0 wt %, 0.05-0.2 wt % of Ti, 0.005-0.05 wt % of Sr, La+Ce<0.5 wt %, Mo<0.1 wt %, and Sc<0.05 wt %, a sum of weight percentages of remaining impurities being controlled to be 0.5 wt % or less. In this invention, amorphous powders of Al—Ti—C—B, Al-20La+Ce, Al-20Mo and Al-3 Sc intermediate alloys are prepared by belt throwing combined with high-energy ball milling. The high-energy ball milling mixing method inevitably leads to a risk of impurity introduction. In addition, Al—Ti—C—B is used as a refiner, which inevitably impedes agglomeration of $TiB_2$ particles and size growth and sinking of $TiAl_3$ phase, which affect the life of the refiner. In addition, the aluminum alloy needs to be heat-treated at 200° C. for 4 h, such that the aluminum alloy has a tensile strength of more than 300 MPa, a yield strength of more than 120 MPa, and an elongation of 15-20%. An additional heat treatment is necessary, which leads to dimensional deformation, lower product yield and potential cost risk.

SUMMARY OF THE INVENTION

An object of the present invention is to provide an aluminum alloy for a new energy vehicle integral die-cast part, a preparation method therefor and an application thereof, in order to overcome the above defects existing in the prior art. The alloy has excellent casting performance and a relatively high tolerance to impurity elements, and can be used for preparing a low-carbon high-strength-and-toughness new energy vehicle lower body product without a heat treatment.

The object of the present invention can be achieved by the following technical solution: an aluminum alloy for a new energy vehicle integral die-cast part, the alloy comprising 7-9 wt % of Si, 0.05-0.25 wt % of Mg, Cu<0.5 wt %, Zn<0.5 wt %, 0.001-0.20 wt % of B, 0.05-0.2 wt % of Ti, 0.1-0.9 wt % of Mn, 0.05-0.3 wt % of Fe, 0.005-0.5 wt % of Sr, Ce<0.5 wt %, 0.01-0.1 wt % of Zr, 0.001-0.3 wt % of Mo, a sum of weight percentages of remaining impurities being controlled to be 1.0 wt % or less, and the balance being Al.

Furthermore, the Zr, Mn, Mo, Ti, B and Ce are added in a form of Al—Zr, Al—Mn, Al—Mo and Al—Ti—B—Ce amorphous intermediate alloys.

Furthermore, the amorphous intermediate alloys are obtained by means of laser evaporation to prepare Al—Zr, Al—Mn, Al—Mo, and Al—Ti—B—Ce.

In particular, the intermediate alloy amorphous powder is obtained by a way of following method: simultaneously placing Al—Zr, Al—Mn, Al—Mo and Al—Ti—B—Ce intermediate alloys as target materials in a closed chamber, evacuating the chamber to such a vacuum that the pressure is reduced to $10^{-5}$ Pa, introducing argon gas of 100-150 kPa, irradiating the four target materials respectively with a pulsed laser beam at a density of more than 100 kW/cm$^2$, and finally collecting the materials to obtain mixed amorphous powders of Al—Zr, Al—Mn, Al—Mo and Al—Ti—

B—Ce with specific compositional ratio. In this intermediate alloy amorphous powder, the elements Zr, Mn, Mo, Ti and Ce are uniformly dispersed, and the average particle size is 20-50 nm. During smelting, Zr, Mn, Mo, Ti and Ce can be uniformly dispersed in molten aluminum at a lower capacity temperature.

The present invention further provides a method for preparing an aluminum alloy for a new energy vehicle integral die-cast part, the method comprising the following steps:

11) putting high-purity aluminum element into a heating furnace, heating the high-purity aluminum element to a temperature of 680° C., and maintaining the temperature for 15 min after melting completely;
12) raising the temperature to 760° C., and adding elemental Si, Zn, and Cu elements;
13) lowering the temperature to 730° C., and adding mixed amorphous powders of Al—Zr, Al—Mn, Al—Mo and Al—Ti—B—Ce;
14) lowering the temperature to 710° C., and adding a pure Mg metal material; and
15) performing casting to obtain an aluminum alloy ingot after all raw materials are melted.

The present invention further provides an application of an aluminum alloy for a new energy vehicle integral die-cast part, i.e., subjecting the aluminum alloy ingot to integral die casting molding to form a new energy vehicle lower body, which comprises the following steps:

21) re-melting the aluminum alloy ingot at a temperature of 750° C., maintaining the temperature, and introducing a protective gas for isolation from the air during the maintaining of the temperature;
22) using 6600T die casting machine, wherein before die casting, a plurality of evacuation valves are arranged at a distal end of the die casting mold, and by adjusting the gas flow rates of different valves for evacuation, the pressure at each valve port is less than 30 mBar, thereby realizing a directional gas flow from proximal end to distal end of the sprue to form a stable pressure differential;
23) pre-filling a barrel with molten alloy obtained in step 21) by means of a punch of the die casting machine, and then injecting the molten alloy into the mold, wherein the punch is a beryllium bronze vacuum sealing punch, an outer diameter of the punch is in transition fit with an inner hole of the barrel to ensure sealing of the barrel, and the punch is externally provided with an atomized spray lubricant and has a built-in annular groove lubricating device, ensuring that the punch is fully lubricated;
24) using various temperature control devices, such as a water-type mold temperature controller, an oil-type mold temperature controller and a high-pressure targeted cooling device, as a mold temperature control system, wherein a temperature of the mold is set to 400° C., the diameter of the punch is increased to 300 mm, the low speed of the injection is controlled to be 0.15-0.3 m/s, a speed of the pre-filling of the barrel is controlled to be 0.4-0.5 m/s, and the speed is increased to 8 m/s at high-speed filling stage, such that the filling of a cavity of the die casting mold can be completed within 200 ms per 90 kg of the molten alloy, whereby a filling distance of 2 m or more is met; a mold retention time of the die-cast part is 45 s; in addition, a high-pressure targeted cooling device is used at a rear wall part to shorten solidification time of a product;
25) spraying a condensed primary product by means of a profiling sprayer to obtain an integral die-cast part, wherein the profiling sprayer is used for spraying, the profiling sprayer has a spray nozzle imitating the structure of the product and performs targeted spraying according to a position of the product, which can realize variable spraying methods at different spraying positions and improve spraying efficiency; and
26) after demolding the integral die-cast part, taking out the cast part by means of a mechanical arm, placing the cast part in a 20° C. constant temperature water bath for cooling for 30 s, taking out the cast part, and leaving the cast part to stand for 72 h to obtain a product of new energy vehicle lower body, wherein the new energy vehicle lower body has a thickness of 1-3 mm, and a distal end of the new energy vehicle integral die-cast part has a tensile strength of 260-300 MPa, a yield strength of more than 110-130 MPa and an elongation of 10-14%.

Compared with the prior art, the present invention has the following advantages:

1) In the present invention, laser evaporation is used to prepare an amorphous powder. Since the laser can heat and evaporate the target in a precise area, no oxidation occurs under argon protection by sequential evaporation of different targets in a preparation chamber. By sequential evaporation, Zr, Mn, Mo, Ti and Ce have been uniformly mixed in the mixed amorphous powder, and by adding aluminum soup, Zr, Mn, Mo, Ti and Ce can be melted and dispersed uniformly at a lower temperature, so as to prevent the occurrence of element segregation, avoid a higher smelting temperature, which leads to serious inhalation and oxidation in the aluminum soup, and also avoid mixing with impurity elements.
2) In the raw material Al—Ti—B—Ce used in the present invention, Ce causes the surface activation energy of the aluminum melt to decrease, the wetting degree of the aluminum melt on the surface of the second phase particles increases, the size of the $TiAl_3$ phase is effectively reduced, the agglomeration of $TiB_2$ particles is hindered. It not only gives full play to heterogeneous nucleation, but also improves the long-term effect of refining. $Ti_2Al_{20}Ce$ is formed. Compared with $TiAl_3$, $Ti_2Al_{20}Ce$ has a slow decomposition rate and a density close to molten Al, which makes it difficult to sink. During refining and temperature maintaining, it has a longer survival time, and in conjunction with the increase of the silicon content of the aluminum alloy, the fluidity of the aluminum alloy is effectively improved and the strength of the aluminum alloy is increased.
3) The uniform dispersion of Mo and Mn in the raw materials used in the present invention changes the sizes and distributions of blocky $Al_2Cu$ phase, long-strip-shaped Al—Si—Cu—Ce phase and black-strip-shaped $Mg_2Si$ phase, and the needle-like Al—Si—Fe phase is transformed into fine dispersively distributed granular Al—Si—Mn—Fe—Mo multi-phase, which hinders the movement of dislocations and has a certain pinning strengthening effect on the alloy matrix, thereby improving the strength and toughness of the alloy and improving the tolerance to the element Fe.

B, 0.05-0.2 wt % of Ti, 0.1-0.9 wt % of Mn, 0.05-0.3 wt % of Fe, 0.005-0.5 wt % of Sr, Ce<0.5 wt %, 0.01-0.1 wt % of Zr, 0.001-0.3 wt % of Mo, a sum of weight percentages of remaining impurities being controlled to be 1.0 wt % or less, and the balance being Al.

Table 1 Table of the contents of the elements in the aluminum alloys of Examples 1-6 and the compositions of the materials prepared therefrom

TABLE 1

Table of the contents of the elements in the aluminum alloys of Examples 1-6 and the compositions of the materials prepared therefrom

| Example | Si | Mg | Cu | Zn | Ti | Mn | Fe | Sr | Ce | Zr | Mo | B |
|---|---|---|---|---|---|---|---|---|---|---|---|---|
| 1 | 7.51 | 0.15 | 0.23 | 0.15 | 0.051 | 0.53 | 0.05 | 0.015 | 0.11 | 0.051 | 0.02 | 0.06 |
| 2 | 7.53 | 0.15 | 0.25 | 0.17 | 0.049 | 0.51 | 0.15 | 0.018 | 0.17 | 0.049 | 0.27 | 0.07 |
| 3 | 8.24 | 0.21 | 0.32 | 0.21 | 0.082 | 0.62 | 0.21 | 0.021 | 0.21 | 0.057 | 0.13 | 0.11 |
| 4 | 8.31 | 0.20 | 0.35 | 0.23 | 0.091 | 0.71 | 0.25 | 0.023 | 0.23 | 0.063 | 0.26 | 0.13 |
| 5 | 8.56 | 0.23 | 0.41 | 0.31 | 0.134 | 0.67 | 0.27 | 0.025 | 0.31 | 0.072 | 0.11 | 0.15 |
| 6 | 8.71 | 0.25 | 0.42 | 0.33 | 0.147 | 0.73 | 0.30 | 0.031 | 0.35 | 0.085 | 0.29 | 0.14 |

4) During the integral die casting molding process, by setting a mold temperature to 400° C., a mold retention time to 45 s and a water cooling time to 30 s, the solid solubility of $Mg_2Si$ and $Al_2Cu$ in the α-Al matrix was increased, and a supersaturated solid solution is formed. After standing for 72 hours, $Mg_2Si$ and $Al_2Cu$ precipitate through natural aging, thus achieving the strengthening and toughening of the aluminum alloy as effective as in a heat treatment, even without a specialized solid solution aging treatment.
5) The aluminum alloy of the present invention has a relatively high silicon content and improved fluidity. Furthermore, by means of the method of adding the amorphous alloys, the burning loss of the alloy elements is reduced, the dispersion uniformity is improved, the persistence of refining and metamorphism effects is realized, the negative influence of the element iron on the elongation of materials is ameliorated, the fluidity and elongation of the material are further improved, and the tolerance to the element Fe is improved, thereby achieving the characteristics of heat-treatment-free high strength and toughness, excellent casting performance and a relatively high tolerance to impurity elements.

DETAILED DESCRIPTION OF EMBODIMENTS

The following is a detailed description of the examples of the present invention. The examples are implemented on the premise of the technical solution of the present invention, and the detailed implementation method and specific operation process are given. However, the scope of protection of the present invention is not limited to the following examples.

Examples 1-6

An aluminum alloy for a new energy vehicle integral die-cast part comprised the following components in percentage as shown in Table 1, with the balance being aluminum and inevitable impurities.

The alloy material comprised 7-9 wt % of Si, 0.05-0.25 wt % of Mg, Cu<0.5 wt %, Zn<0.5 wt %, 0.001-0.20 wt % of 1) Materials were prepared according to Table 1 above, wherein Al—Zr, Al—Mn, Al—Mo and Al—Ti—B—Ce intermediate alloys as target materials were placed in a closed chamber, the chamber was evacuated to such a vacuum that the pressure was reduced to $10^{-5}$ Pa, argon gas at 120 kPa was introduced, the four target materials were respectively irradiated with a pulsed laser beam at a density of more than 100 kW/cm$^2$, and finally, the materials were collected to obtain mixed amorphous powders of Al—Zr, Al—Mn, Al—Mo and Al—Ti—B—Ce at a specific compositional ratio. In this intermediate alloy amorphous powder, the elements Zr, Mn, Mo, Ti and Ce were uniformly dispersed, and the average particle size was 20-50 nm. During smelting, Zr, Mn, Mo, Ti and Ce could be uniformly dispersed in the molten aluminum at a lower capacity temperature;
2) high-purity aluminum element was put into a heating furnace and heated to a temperature of 680° C., and after melting completely, the temperature was maintained for 15 min;
3) the temperature was raised to 760° C., and elemental Si, Zn, and Cu elements were added;
4) the temperature was reduced to 730° C., and mixed amorphous powders of Al—Zr, Al—Mn, Al—Mo and Al—Ti—B—Ce were added;
5) the temperature was reduced to 710° C., and a pure Mg metal material was added; and
6) after all the raw materials were melted, casting was performed to obtain an aluminum alloy ingot.

The aluminum alloy ingot obtained in step 6) was remelted at a temperature of 750° C., the temperature was maintained, a protective gas was introduced for isolation from the air during the maintaining of the temperature, the molten aluminum alloy was then injected into the die casting mold, and after die pressing, a 3 mm thick tensile sheet specimen was obtained.

The die casting mold was a mold temperature controller, and the temperature thereof was maintained at 250-350° C. in advance. In addition, the die casting machine was equipped with a heat-insulating barrel. During die casting, the barrel temperature was maintained at 200-250° C., an injection speed of 4 m/s was used, and the molten aluminum alloy ingot was rapidly cooled and molded under a pressure of 20-40 MPa. The tensile sheet specimen had a tensile strength of 260-300 MPa, a yield strength of 110-130 MPa and an elongation of 10-14%.

Table 2 Table of the mechanical properties of tensile sheets corresponding to Examples 1-6

TABLE 2

Table of the mechanical properties of tensile sheets corresponding to Examples 1-6

| Example | Mechanical properties | | |
|---|---|---|---|
| | Tensile strength (MPa) | Yield strength (MPa) | Elongation (%) |
| 1 | 271 | 118 | 14.00 |
| 2 | 276 | 120 | 13.78 |
| 3 | 282 | 123 | 12.81 |
| 4 | 287 | 125 | 12.67 |
| 5 | 291 | 127 | 11.57 |
| 6 | 294 | 129 | 11.42 |

The aluminum alloy ingot obtained by the above method was made into a product of new energy vehicle lower body. Taking the aluminum alloy ingot made in each example as an example, integral die casting molding was performed to make a new energy vehicle lower body. The method therefor comprised the following steps:

21) re-melting the aluminum alloy ingot at a temperature of 750° C., maintaining the temperature, and introducing a protective gas for isolation from the air during the maintaining of the temperature;

22) using 6600T die casting machine, wherein before die casting, a plurality of evacuation valves were arranged at a distal end of the die casting mold, and by adjusting the gas flow rates of different valves for evacuation, the pressure at each valve port was less than 30 mBar, thereby realizing a directional gas flow from proximal end to distal end of the sprue to form a stable pressure differential;

23) pre-filling a barrel with molten alloy obtained in step 21) by means of a punch of the die casting machine, and then injecting the molten alloy into the mold, wherein the punch was a beryllium bronze vacuum sealing punch, an outer diameter of the punch was in transition fit with an inner hole of the barrel to ensure the sealing of the barrel, and the punch was externally provided with an atomized spray lubricant and had a built-in annular groove lubricating device, ensuring that the punch was fully lubricated;

24) using a mold temperature control system, which was an oil-type mold temperature controller, wherein a temperature of the mold was set to 400° C., the diameter of the punch was increased to 300 mm, the low speed of the injection was controlled to be 0.2 m/s, the speed of the pre-filling of the barrel was controlled to be 0.45 m/s, and the speed was increased to 8 m/s at high-speed filling stage, such that the filling of the cavity of the die casting mold could be completed within 200 ms per 90 kg of the molten alloy, whereby a filling distance of 2 m or more was met; a mold retention time of the die-cast part was 45 s; in addition, a high-pressure targeted cooling device was used at a rear wall part to shorten solidification time of a product; and in this example, the mold was a forward engine room mold;

25) spraying a condensed primary product by means of a profiling sprayer to obtain an integral forward engine room die-cast part, wherein the profiling sprayer was used for spraying, the profiling sprayer had a spray nozzle imitating a structure of the product and performed targeted spraying according to a position of the product, which could realize variable spraying methods at different spraying positions and improve spraying efficiency; and 26) after demolding the integral forward engine room die-cast part, taking out the cast part by means of a mechanical arm, placing the cast part in a 20° C. constant temperature water bath for cooling for 30 s, taking out the cast part, and leaving the cast part to stand for 72 h to obtain a new energy vehicle forward engine room product.

The performance of the obtained forward engine room product was tested, and the testing process and results were as follows: taking Examples 3 and 6 as examples, the mechanical properties of the new energy vehicle forward engine room products made according to the above method from the prepared aluminum alloy ingots at different positions proximal end and distal end of the sprue were as shown in Tables 3 and 4 below, wherein the numbers 1 #, 2 #, 3 #, 4 #, 5 # and 6 # were respectively numbers by which the mechanical properties of the new energy vehicle forward engine room products were tested at different positions from the inlet sprue as test points.

Table 3 Mechanical properties of the new energy vehicle forward engine room product made according to the above method from the aluminum alloy ingot made in Example 3 in different positions

TABLE 3

Mechanical properties of the new energy vehicle forward engine room product made according to the above method from the aluminum alloy ingot made in Example 3 in differnt positions

| No. | Distance to inlet sprue (mm) | Tensile strength (MPa) | Yield strength (MPa) | Elongation (%) |
|---|---|---|---|---|
| 1# | 150 | 287 | 122 | 12.81% |
| 2# | 470 | 276 | 120 | 12.37% |
| 3# | 690 | 273 | 119 | 11.98% |
| 4# | 940 | 267 | 117 | 11.32% |
| 5# | 1500 | 265 | 115 | 11.21% |
| 6# | 2300 | 263 | 113 | 10.54% |

Table 4 Mechanical properties of the new energy vehicle forward engine room product made according to the above method from the aluminum alloy ingot made in Example 6 in different positions

TABLE 4

Mechanical properties of the new energy vehicle forward engine room product made according to the above method from the aluminum alloy ingot made in Example 6 in different positions

| No. | Distance to inlet sprue (mm) | Tensile strength (MPa) | Yield strength (MPa) | Elongation (%) |
|---|---|---|---|---|
| 1# | 150 | 297 | 128 | 11.37% |
| 2# | 470 | 286 | 126 | 11.14% |
| 3# | 690 | 283 | 123 | 10.98% |
| 4# | 940 | 277 | 121 | 10.62% |
| 5# | 1500 | 275 | 118 | 10.21% |
| 6# | 2300 | 263 | 116 | 10.14% |

It could be seen from the above tables 3 and 4 that although the content of iron in the alloy of the present invention was relatively high, up to 0.3 wt % (the content of Fe in general automobile die casting alloy needed to be controlled within 0.15 wt %), the mechanical properties of the obtained alloy could still reach a tensile strength of 260-300 MPa, a yield strength of 110-130 MPa, an elongation of 10-14%, and the tolerance to the element Fe was improved. The new energy vehicle forward engine room products made of this alloy had, at different positions, a tensile strength of 260-300 MPa, a yield strength of 110-130 MPa and an elongation of 10-14%; moreover, the strengthening and toughening of the aluminum alloy as effective as in a heat treatment could be achieved, even without a specialized solid solution aging treatment; in addition, at the farthest distance distal to the inlet sprue, i.e. 2300 mm, the tensile strength was 260-300 MPa, the yield strength was 110-130 MPa, and the elongation was 10-14%. The material had excellent casting performance to ensure excellent mold filling capacity.

In the present invention, the tensile strength, yield strength and elongation were detected according to the national standard GB/T 228.1-2010.

The invention claimed is:

1. A method for preparing an aluminum alloy for a new energy vehicle integral die-cast part, wherein the alloy comprises 7-9 wt % of Si, 0.05-0.25 wt % of Mg, Cu<0.5 wt %, Zn<0.5 wt %, 0.001-0.20 wt % of B, 0.05-0.2 wt % of Ti, 0.1-0.9 wt % of Mn, 0.05-0.3 wt % of Fe, 0.005-0.5 wt % of Sr, Ce<0.5 wt %, 0.01-0.1 wt % of Zr, 0.001-0.3 wt % of Mo, a sum of weight percentages of remaining impurities being controlled to be 1.0 wt % or less, and the balance being Al;

wherein the method comprises following steps:

putting aluminum element into a heating furnace, heating the aluminum element to a temperature of 680° C., and maintaining the temperature for 15 min after melting completely;

raising the temperature to 760° C., and adding Si, Zn and Cu elements;

lowering the temperature to 730° C., and adding Al—Zr, Al—Mn, Al—Mo and Al—Ti—B—Ce amorphous intermediate alloys; wherein the amorphous intermediate alloys are obtained by a way of following method:

placing Al—Zr, Al—Mn, Al—Mo and Al—Ti—B—Ce intermediate alloys as target materials in a closed chamber, evacuating the chamber to a vacuum and introducing argon gas of 100-150 kPa, irradiating four target materials respectively with a pulsed laser beam, and finally collecting mixed amorphous powders of Al—Zr, Al—Mn, Al—Mo and Al—Ti—B—Ce with set compositional ratio;

wherein a vacuum degree of the chamber is $10^{-5}$ Pa, and a laser energy density of the pulsed laser beam is more than 100 kW/cm$^2$;

lowering the temperature to 710° C., and adding pure Mg metal material; and performing casting to obtain an aluminum alloy ingot after all raw materials are melted.

2. The method according to claim 1, wherein the alloy comprises 0.11-0.35 wt % of Ce.

3. The method according to claim 1, wherein the alloy comprises 7.51 wt % of Si, 0.15 wt % of Mg, 0.23 wt % of Cu, 0.15 wt % of Zn, 0.051 wt % of Ti, 0.53 wt % of Mn, 0.05 wt % of Fe, 0.015 wt % of Sr, 0.11 wt % of Ce, 0.051 wt % of Zr, 0.02 wt % of Mo, 0.06 wt % of B.

4. The method according to claim 1, wherein the alloy comprises 7.53 wt % of Si, 0.15 wt % of Mg, 0.25 wt % of Cu, 0.17 wt % of Zn, 0.049 wt % of Ti, 0.51 wt % of Mn, 0.15 wt % of Fe, 0.018 wt % of Sr, 0.17 wt % of Ce, 0.049 wt % of Zr, 0.27 wt % of Mo, 0.07 wt % of B.

5. The method according to claim 1, wherein the alloy comprises 8.24 wt % of Si, 0.21 wt % of Mg, 0.32 wt % of Cu, 0.21 wt % of Zn, 0.082 wt % of Ti, 0.62 wt % of Mn, 0.21 wt % of Fe, 0.021 wt % of Sr, 0.21 wt % of Ce, 0.057 wt % of Zr, 0.13 wt % of Mo, 0.11 wt % of B.

6. The method according to claim 1, wherein the alloy comprises 8.31 wt % of Si, 0.20 wt % of Mg, 0.35 wt % of Cu, 0.23 wt % of Zn, 0.091 wt % of Ti, 0.71 wt % of Mn, 0.25 wt % of Fe, 0.023 wt % of Sr, 0.23 wt % of Ce, 0.063 wt % of Zr, 0.26 wt % of Mo, 0.13 wt % of B.

7. The method according to claim 1, wherein the alloy comprises 8.56 wt % of Si, 0.23 wt % of Mg, 0.41 wt % of Cu, 0.31 wt % of Zn, 0.134 wt % of Ti, 0.67 wt % of Mn, 0.27 wt % of Fe, 0.025 wt % of Sr, 0.31 wt % of Ce, 0.072 wt % of Zr, 0.11 wt % of Mo, 0.15 wt % of B.

8. The method according to claim 1, wherein the alloy comprises 8.71 wt % of Si, 0.25 wt % of Mg, 0.42 wt % of Cu, 0.33 wt % of Zn, 0.147 wt % of Ti, 0.73 wt % of Mn, 0.30 wt % of Fe, 0.031 wt % of Sr, 0.35 wt % of Ce, 0.085 wt % of Zr, 0.29 wt % of Mo, 0.14 wt % of B.

9. The method according to claim 1, wherein the alloy has a tensile strength of 260-300 MPa, a yield strength of 110-130 MPa and an elongation of 10-14%.

* * * * *